United States Patent [19]

Fischer

[11] Patent Number: 4,901,913

[45] Date of Patent: Feb. 20, 1990

[54] DAMAGE-RESISTANT MAILBOX

[76] Inventor: Glenn N. Fischer, 7595 E. Singer Rd., Dayton, Ohio 45424

[21] Appl. No.: 378,540

[22] Filed: Jul. 11, 1989

Related U.S. Application Data

[62] Division of Ser. No. 766,380, Aug. 16, 1985, Pat. No. 4,888,823.

[51] Int. Cl.[4] ..... B65D 91/00

[52] U.S. Cl. ..... 232/17; 232/38

[58] Field of Search ..... 232/17, 38, 34

[56] References Cited

U.S. PATENT DOCUMENTS 3,827,626 8/1974 Paigle ..... 232/17

4,815,656 3/1989 Smith et al. ..... 232/17 X

*Primary Examiner*—Robert W. Gibson, Jr.

*Attorney, Agent, or Firm*—Biebel, French & Nauman

[57] ABSTRACT

A mailbox for receiving delivered mail includes a housing and a post for mounting the box to the ground. A door is connected to a shaft rotatably secured to the bottom edge of a door opening, and the door extends beyond the opening into a tail portion. A part of the housing floor is formed from a resilient material so that the door is normally stopped thereby upon opening. Should the door be forced further, the material will yield to allow the door to swing below the box to prevent damage. A security latch, hidden beneath the housing, includes a leaf spring normally positioned behind the door tail portion to prevent its opening. The spring may be moved into a slot in the door shaft, where the spring cooperates with a notch in the door to permit its opening. Upon closing of the door, the spring is released to its normal position, whereupon the door is again held shut. The flag target is carried at the end of a flag shaft that is rotatably and slidably secured to the housing interior. A spring connects the shaft to the rear wall of the housing. The flag is extended by pulling the target and shaft from the box and rotating the target to engage the wall of the box, and is returned by rotating the target to allow the spring to retract the flag into the box. An energy absorbing mount for the post includes a resilient member secured by a single bolt between two plates, one plate in turn attached to the post and the other being secured to the ground.

4 Claims, 3 Drawing Sheets

DAMAGE-RESISTANT MAILBOX

This is a divisional of application Ser. No. 766,380 filed Aug. 16, 1985 now U.S. Pat. No. 4,858,823.

BACKGROUND OF THE INVENTION

The present invention relates generally to a mailbox of a type often used in rural areas for receiving delivered mail. More specifically, the present invention relates to a mailbox incorporating several features that render the mailbox more resistant to damage due to vandalism.

In rural and many suburban areas, mail is delivered to residences and places of business by a delivery person placing the mail into a mailbox positioned at the side of a street or road. Such a mailbox typically includes a box-like housing having a door located on the front of the housing, and the housing is mounted to a post which is secured in the ground. A flag is usually pivotally connected to the mailbox housing, movable between a lowered position and a raised position. The flag can be moved to the raised position to indicate either that a delivery has been made or that items are contained within the box for pickup by the delivery person.

In recent years, many areas have been plagued with considerable damage done to mailboxes, usually as the result of vandalism. Typically, commercially available mailboxes are constructed of lightweight material in an effort to keep costs and prices low. However, such mailboxes are not able to resist damage that can be caused by acts of vandalism. Common forms of such damage include a caved-in box, a bent or twisted door or flag, and removal of the box from the support post.

What is needed therefore, is a mailbox design which is better able to withstand acts of vandalism without suffering damage that requires replacement of the mailbox. In addition, the box should be able to resist tampering with the mailbox contents. Such a design should not, however, require changes in the routine of the delivery person with respect to operation of the box.

SUMMARY OF THE INVENTION

The present invention is embodied within a mailbox for receiving delivered mail that includes a box-like housing having first and second opposed side walls and a planar bottom wall. The housing further defines an opening at a front end of the walls. The mailbox includes a substantially planar door for closing the opening, as well as means for mounting the housing in a fixed location.

A shaft is rotatably mounted between the side walls of the housing along one side of the housing opening, generally adjacent to and within the plane of the bottom wall. The door is connected to the shaft such that the door pivots with the shaft to open and close the opening. Further, the door extends beyond the shaft opposite the opening to define a tail portion for the door. At least a portion of the bottom wall adjacent the shaft is constructed from a resilient material, connected to the remaining portion of the bottom wall. The resilient material normally acts as a stop for the door by movement of the door tail portion against the material as the door is opened. However, the resilient material is sufficiently yieldable to permit movement of the tail portion therepast upon exertion of undue opening force upon the door.

In a second improvement, a security latch assembly is provided in which the shaft defines a slot extending across the shaft perpendicular to its axis and adjacent to one of the side walls. The slot is disposed on the shaft downwardly when the door is closed. The door defines a notch in its tail portion along a side edge thereof adjacent to the first side wall.

A leaf spring having first and second ends, the spring being of a thickness less than the width of either of the slot and the notch, is connected at its first end to an inner surface of the first side wall. The spring extends along and generally outwardly from the first wall in a direction generally perpendicular to the shaft. The spring is connected so that the second end is normally disposed beneath but substantially adjacent to the shaft and adjacent to the door tail portion. In this position, the spring prevents the door from being opened. The spring is movable by exertion of force thereon from its normal position toward the side wall and into the slot, allowing the housing door to be opened only once. Afterwards, the spring returns to its normal, or locking, position. Only a person with knowledge of the location and position of the latch may open the door when the spring is positioned behind the door tail.

The latch may be deactivated by engaging a detented screw to hold the spring in a position which does not interfere with the opening or closing of the door.

As a third improvement, a flag-mounting arrangement is provided for the mailbox including an elongated flag shaft having an axis. Means is provided for securing the shaft to an inner surface of one wall, the shaft extending from a first end at the rear to a second end at the front of the mailbox housing. The securing means is constructed to permit rotation of the shaft about its axis, as well as sliding movement of the shaft along its axis. A spring means connects the first end of the shaft with the rear of the housing. A target is carried on the shaft at its second end. Means for engaging the target outside the housing but adjacent to the front thereof is also provided, whereby the target is displayed by sliding the shaft from the housing to move the target out of the housing, and by rotating the shaft for engagement of the target with the engaging means.

Finally, the present invention also provides a mounting arrangement for the mailbox including an upright post connected at an upper end to the bottom mailbox wall. A first plate is connected to the post at a lower end thereof. A second plate is secured by appropriate means to the ground. A resilient member is disposed on the second plate and the first plate is in turn placed upon the resilient member. Means is provided for drawing the first and second plates together by a selected amount for exerting selectable pressure upon the resilient member.

Accordingly, it is an object of the present invention to provide a mailbox design that enables the mailbox to better resist acts of vandalism upon the mailbox; to provide such a mailbox in which a door mounting arrangement serves to protect against bending and twisting of the door; to provide such a mailbox that includes a security latch to protect against unwanted opening of the mailbox door while permitting opening of the door for delivery of mail; to provide such a mailbox in which the flag is protected from bending or twisting; and to provide such a mailbox in which the mounting arrangement is capable of absorbing shocks to the box caused by blows.

Other objects and advantages of the present invention will be apparent from the following description, the accompanying drawings, and the appended claims.

DETAILED DESCRIPTION OF THE PREFERRED EMBODIMENT

Figure 1:
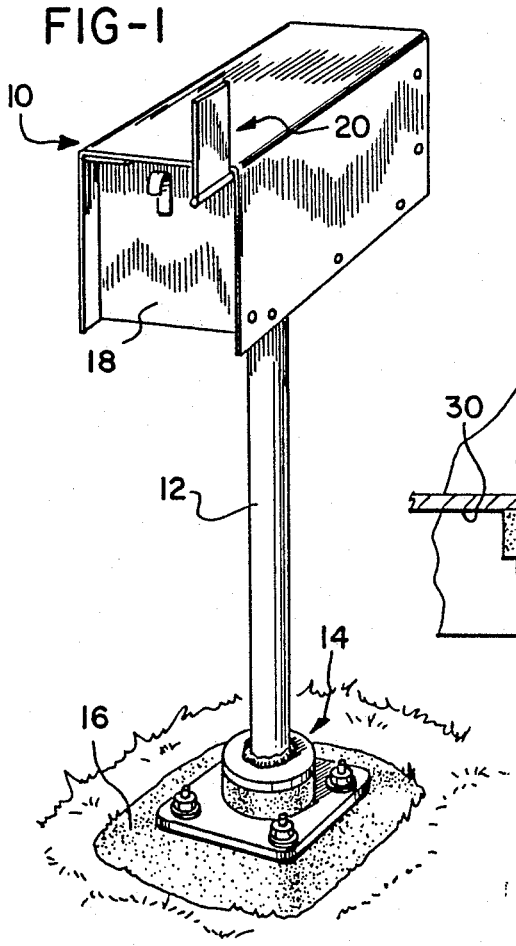
FIG. 1 is a perspective view showing generally a mailbox constructed in accordance with the present invention.

Referring now to the drawings, and in particular to FIG. 1, a mailbox is shown which is constructed in accordance with the present invention. A box-like housing 10 is mounted to a post 12 which is secured by a mounting means 14 to a concrete mounting pad 16 within the ground. A door 18 is provided on the front of housing 10 for closing the mailbox. A flag assembly 20 may be extended from housing 10 for signaling the mail delivery person or the mailbox owner.

While the mailbox is generally described herein as being of a type that is mounted to a post for roadside positioning, and while the problems outlined in the Background section above are most particular to such mailbox installations, it will be recognized that, insofar as housing 10 and the details of its construction are concerned, the present invention is equally applicable to other types of mailboxes. Specifically, mailboxes of the type which are mounted directly to the building which they serve may be constructed in accordance with, and are considered to be within the scope of, the present invention. In such a case, appropriate means for securing the housing 10 in a fixed location are substituted for post 12 and mounting means 14.

Figure 3:
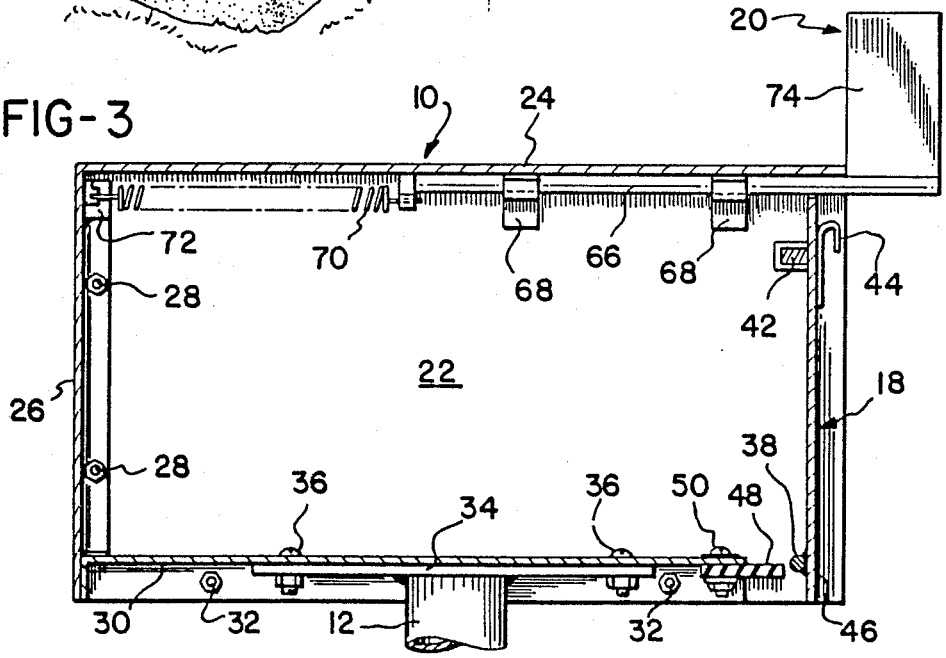
FIG. 3 is a sectional view of the mailbox housing.
Figure 2:
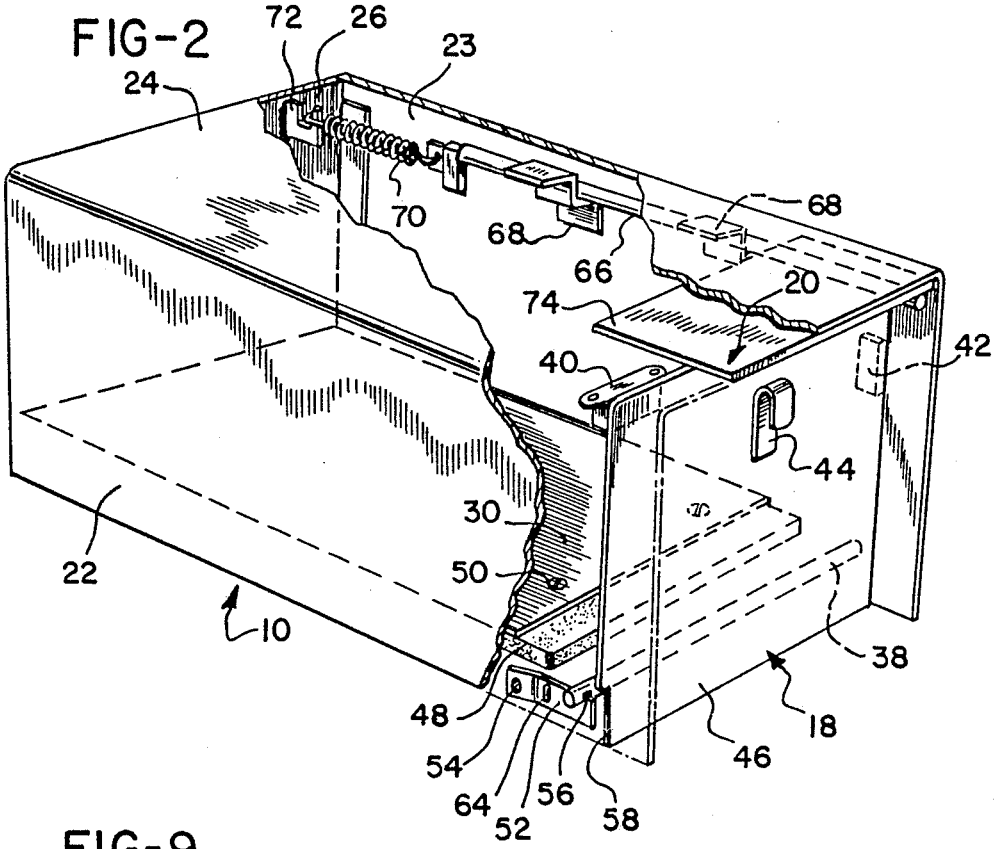
FIG. 2 is a perspective view of the housing portion of the mailbox of FIG. 1, with a portion of the top and side wall broken away.

The construction of the housing 10 may be seen in detail by reference to FIGS. 2 and 3. Opposed side walls 22 and 23 and a top wall 24 are preferably formed from a single piece of sheet metal material which is bent to define walls 22, 23 and 24. Alternatively, walls 22, 23 and 24 could be formed as individual parts, or could be formed from other appropriate materials such as fiberglass or plastic. A rear wall 26 is connected by bolts 28, or by welding or the like, to side walls 22 and 23. A planar bottom wall 30 is also connected between side walls 22 and 23, secured by bolts 32 or by welding or the like.

As seen in FIG. 3, post 12 is connected at its upper end to a plate 34, which is in turn connected by bolts 36 to bottom wall 30 for securing housing 10 to post 12.

A shaft 38 is connected for rotation betwen side walls 22 and 23. Door 18 is attached to shaft 38, such as by welding, so that pivotal movement of door 18 with shaft 38 enables door 18 to be opened and closed. In the preferred embodiment, the rotational mounting of shaft 38 within walls 22 and 23 is achieved simply by providing shaft 38 to be slightly longer than the distance between the inner surfaces of walls 22 and 23. The ends of shaft 38 are placed within holes slightly larger than the diameter of shaft 38 which are formed into side walls 22 and 23. Door 18 is attached to shaft 38 to completely close the opening into the housing 10. As shown in FIG. 2, a catch 40, which is preferably a magnetic catch, is attached to top wall 24 near side wall 22 for securing door 18 in a closed position. In addition, a stop block 42 is secured to the inner surface of side wall 23 for halting movement of door 18 during closing. A handle 44 is attached to the outer surface of door 18.

Figure 4:
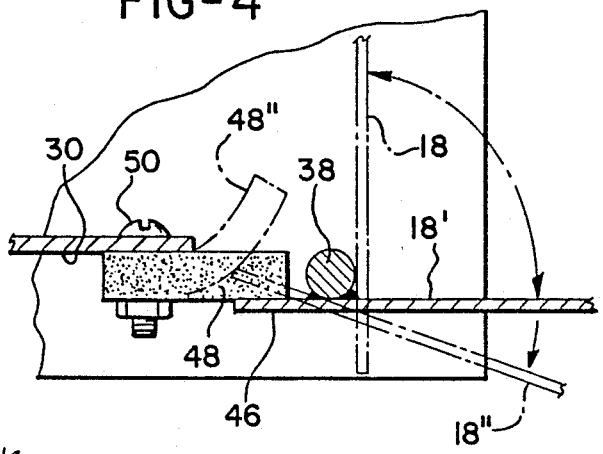
FIG. 4 is an enlarged portion of the sectional view of FIG. 3, illustrating the door mounting arrangement and its operation.

In a conventional mailbox, damage to the mailbox door can occur by forcibly moving the door beyond its fully open position. To provide protection against such damage, the mailbox according to the present invention includes door 18 which is connected to shaft 38 such that a portion 46 of door 18 extends beyond shaft 38 to define a tail for the door. The portion of bottom wall 30 which is closest to shaft 38 is defined by a resilient block 48 formed from a material such as rubber and attached by screws 50 to the remaining, rigid portion of bottom wall 30. As shown in FIG. 4, normal movement of the door from the position indicated at 18 to its open position at 18' causes tail portion 46 of the door to move into contact with block 48. This will stop door 18, holding it in the outwardly extending, normally open position. However, in the event undue force is exerted upon door 18, tail portion 46 will force its way past block 48, as indicated by door 18" and block 48". Once tail portion 46 moves beyond block 48, the door will simply swing down beneath housing 10, without incurring any damage.

Figure 5:
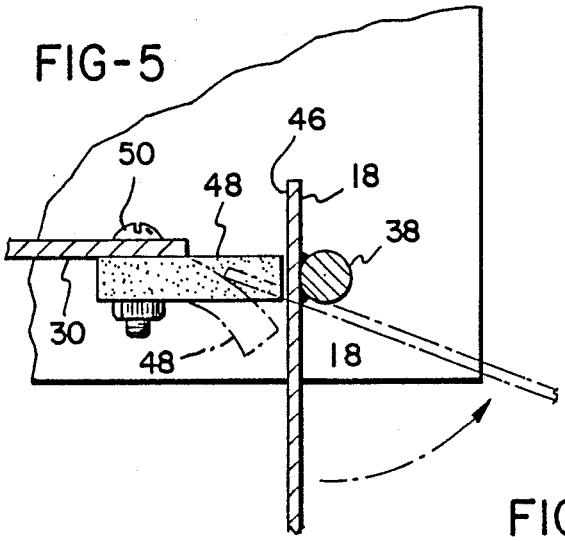
FIG. 5 is a view similar to FIG. 4, further illustrating the door mounting arrangement and its operation.

The door is returned to its normal operating position simply by again moving tail portion 46 past block 48, but in an opposite direction as shown in FIG. 5.

In order to prevent unwanted access to delivered items within the mailbox, while still permitting opening of the mailbox door by the delivery person, a hidden security latch is provided as shown in FIGS. 6–9. In each of these views, bottom wall 30 has been eliminated for purposes of clarity. To understand the positional relationship between the security latch and bottom wall 30, reference should be made to FIG. 2.

Figure 6:
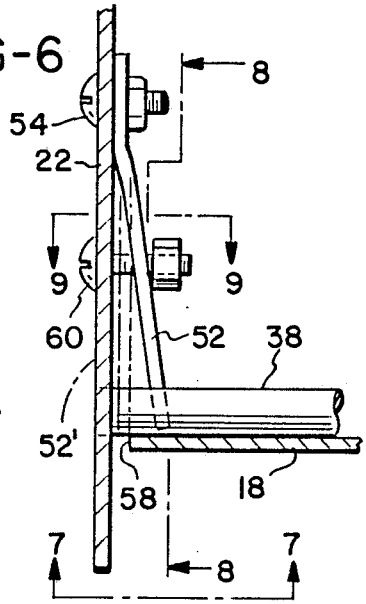
FIG. 6 is a sectional view through a front corner of the mailbox housing, illustrating the hidden security latch, with the bottom wall of the housing removed for clarity.
Figure 8:
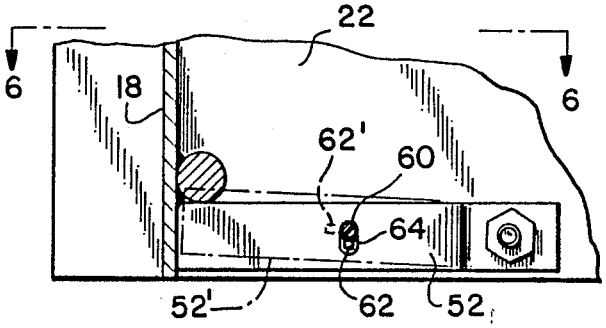
FIG. 8 is a view taken generally along line 8—8 of FIG. 6.

Referring now to FIG. 6, the security latch includes a leaf spring 52 which is secured near a bottom edge to side wall 22 by a bolt 54. Leaf spring 52 is normally urged away from wall 22 as shown in FIG. 6. As is further shown in FIG. 8, leaf spring 52 is normally positioned just beneath and in contact with shaft 38.

Figure 9:
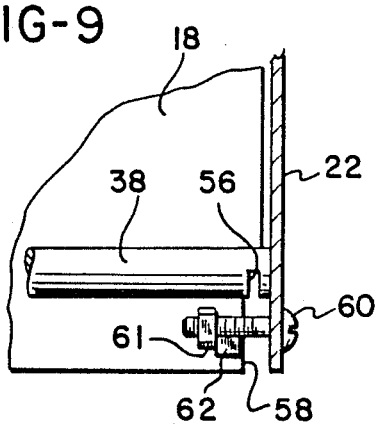
FIG. 9 is a view taken generally along line 9—9 of FIG. 6, with the leaf spring removed.

Referring now to FIG. 9, it should first be noted that leaf spring 52 has been omitted in order to illustrate features of surrounding parts. A slot 56 is provided in the lower surface (when door 18 is closed) of shaft 38. Slot 56 is positioned near side wall 22 and is of a width at least slightly greater than that of leaf spring 52. A notch 58 is formed into the lower corner of door 18 adjacent slot 56, with slot 56 and notch 58 being almost aligned, but with notch 58 extending slightly further from wall 22 than slot 56. Notch 58 can also be seen by reference to FIG. 7. A bolt 60 to which is attached a self-locking nut 61 having a tab 62 extending from the nut is connected near the bottom edge of side wall 22. As seen by reference back to FIGS. 6 and 8, bolt 60 passes through an elongated opening 64 in leaf spring 52.

Figure 7:
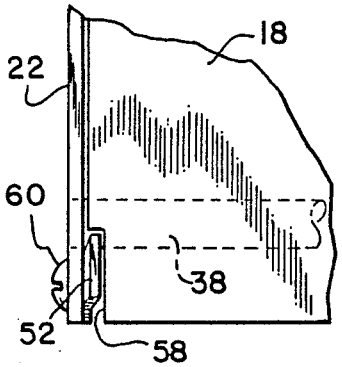
FIG. 7 is a view taken generally along line 7—7 of FIG. 6.

To activate the security latch, the mailbox owner reaches beneath the box and moves the leaf spring 52 from the normal position indicated in FIG. 6 toward side wall 22 as indicated by 52'. As leaf spring 52 is moved into alignment with slot 56 (FIG. 9), an upward force exerted on spring 52 will move it into slot 56, thereby occupying a position such as is shown in FIG. 7. (Alternatively, spring 52 may be provided with an upward bias, so that direct upward movement of spring 52 by the owner to place it into slot 56 is not needed.) The latch is now activated and ready for use.

As the delivery person opens door 18 to deposit mail within the box, rotation of shaft 38 moves spring 52 out of slot 56 as the slot is rotated away. The outward tendency of leaf spring 52 then causes the spring to move into contact with the side of notch 58 formed within door 18. Because of the notch, however, spring 52 has no effect upon the opening of door 18. As door 18 is subsequently closed, spring 52 will not move back into slot 56, due to the prior downward displacement of the spring and the slight offset of the side edge of notch 58 with respect to slot 56. Once door 18 has been returned to its closed position, the edge of notch 58 is no longer in contact with leaf spring 52, which returns to its normal position as shown in FIG. 6. Since the end of spring 52 is now positioned immediately behind the tail portion of door 18, however, the door cannot be opened until the security latch has been reset.

In the event the owner wishes to disable the security latch, spring 52 may be moved against side wall 22 as is done when the latch is being actuated. Bolt 60 is then rotated so as to move tab 62 against leaf spring 52 as shown by tab 62' in FIG. 8. Spring 52 is then held within slot 56 and notch 58, thereby permitting unrestricted opening of door 18.

The flag-mounting arrangement for the mailbox according to the present invention can be seen by reference to FIGS. 2 and 3. A flag shaft 66 is positioned within the housing in an upper corner adjacent side wall 23 and top wall 24. A pair of brackets 68 are connected between walls 23 and 24 for holding shaft 66 in position. Brackets 68 do not completely clamp shaft 66 into position, however, which may be rotated or moved laterally within bracket 68.

A spring 70 is connected between an end of shaft 66 and a bracket 72 connected to rear wall 26 of the mailbox housing. At the opposite end of shaft 66, a flat target 74 is connected. Target 74 is preferably painted red, yellow or the like so as to be more easily visible.

As seen in FIG. 2, the flag 20 is normally held within the mailbox housing. To display the flag, the target 74 is pulled outwardly from the housing and is rotated with shaft 66 until target 74 engages the edge of top wall 24, as shown in FIG. 3. The target 74 is then held securely in place. In the event some other housing design is utilized, the flag mounting means may still be used, but it may be necessary to provide some stop means secured to the housing against which target 74 can rest when moved to the display position.

To lower the flag, target 74 is rotated back to its original, horizontal position, whereat spring 70 will retract shaft 66 to move target 74 back into the box.

Figure 10:
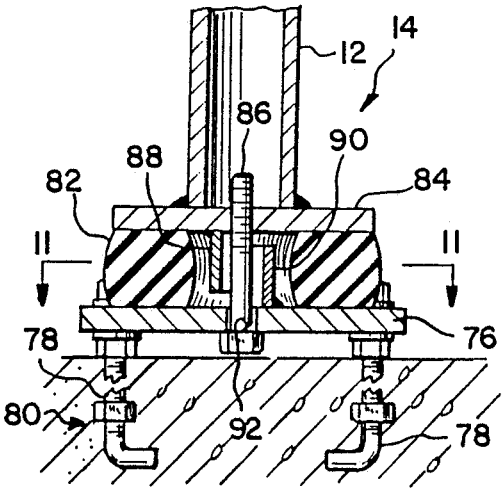
FIG. 10 is a sectional view taken through the means for mounting the mailbox post to the ground.
Figure 11:
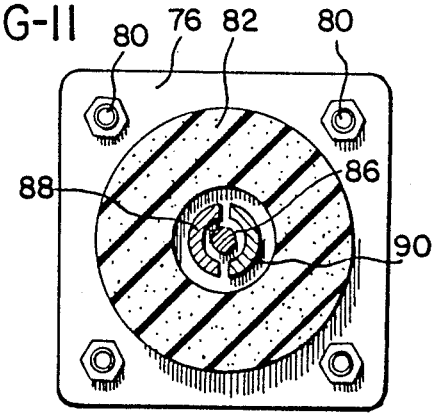
FIG. 11 is a sectional view taken generally along line 11—11 of FIG. 10.

The means by which the mailbox may be mounted to the ground can be seen by reference to FIGS. 10 and 11. A mounting plate 76 is connected by anchor bolts 78 to a concrete mounting pad 80 or is otherwise securely fastened to the ground. A hard rubber ring 82 is placed onto plate 76. An attachment plate 84 is in turn placed upon ring 82, with mailbox post 12 being fastened to plate 84. Plate 84 is then drawn towards plate 76 by tightening of a bolt 86.

In practice, bolt 86 will first be used to attach plate 76 and ring 82 to plate 84 before plate 76 is secured by bolts 78 to the ground.

A pair of semi-cylindrical members 88 and 90 are connected one each to plates 76 and 84 as is shown in FIG. 10. A small gap is left between members 88 and 90 which, as shown in FIG. 11, surround bolt 86. The gap between members 88 and 90 is oriented so as to be perpendicular to the orientation direction for housing 10. Members 88 and 90 serve to prevent twisting of the mailbox upon its mounting, which could otherwise result since it is secured by only the single bolt 86.

The mounting arrangement shown in FIGS. 10 and 11, by virtue of the single bolt 86 and the hard rubber ring 82, is capable of absorbing energy delivered to the mailbox as a result of a blow to the side of the housing. This is because ring 82 will permit the box and mounting post to sway from side to side while the energy is dissipated. Depending upon the degree to which bolt 86 has been tightened, the amount of "springiness" within the mounting pad and the extent to which the box may be moved from an upright position can be regulated.

It should further be noted that bolt 86 is provided with a notch 92 adjacent its head. Notch 92 is provided as a controlled failure point for the mailbox mounting so that in the event the box is struck by a vehicle, a snowplow or the like, bolt 92 will fail, thereby possibly resulting in the mailbox being sufficiently undamaged to be reused, despite being torn from its mounting. As a second advantage, any damage to a vehicle striking the mailbox may be reduced.

As described herein, the preferred embodiment for the mailbox in accordance with the present invention includes each of the features set forth above. It will be recognized, however, that any one or various combinations of the disclosed features may be used within a mailbox as desired, and that such will be within the scope of the present invention.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A security latch assembly for a mailbox for receiving delivered mail, said mailbox including a box-like housing having first and second opposed side walls and defining an opening at one end of said walls, a substantially planar door for closing said opening, and means for mounting said housing in a fixed location, the latch assembly comprising:

a shaft rotatably mounted between said walls along one side of said opening;

said door being connected to said shaft such that said door pivots with said shaft to open and close said opening, and such that said door extends beyond said shaft opposite said opening to define a tail portion for said door;

said shaft defining a slot extending across said shaft perpendicular to its axis, adjacent to said first wall, said slot being disposed on said shaft downwardly when said door is closed;

said door defining a notch in said tail portion along a side edge thereof adjacent said first wall and generally aligned with said slot; and a leaf spring having first and second ends, said spring being of a thickness less than the width of either of said slot and said notch;

said leaf spring being connected at said first end to an inner surface of said first wall to extend along and, when in a normal position, generally outwardly from said first wall in a direction generally perpendicular to said shaft, said spring being connected so that said second end is normally disposed beneath but substantially adjacent to said shaft and adjacent to said tail portion;

said spring being movable by exertion of force thereon into said slot.

2. A security latch as defined in claim 1, wherein said slot is disposed along said shaft with respect to said notch such that when said spring is moved into said slot, said spring is held at least slightly away from a surface of said notch.

3. A security latch as defined in claim 1, wherein said spring is connected to said first wall to define an upward bias for said spring, whereby said spring is held against said shaft when in said normal position, and is held within said slot when moved thereinto.

4. A security latch as defined in claim 1, wherein said mailbox housing includes a bottom wall connected between said first and second side walls, said spring being connected to said first wall beneath said bottom wall.

* * * * *